US006189695B1

(12) United States Patent
Ching-rong

(10) Patent No.: US 6,189,695 B1
(45) Date of Patent: Feb. 20, 2001

(54) STRUCTURE FOR FOLDABLE STORAGE BINS

(76) Inventor: Liu Ching-rong, No. 31, Lane 9, Sec. 3, Chung-King N. Rd., Taipei (TW)

( * ) Notice: Under 35 U.S.C. 154(b), the term of this patent shall be extended for 0 days.

(21) Appl. No.: 09/564,545

(22) Filed: May 4, 2000

(51) Int. Cl.[7] ..... B65D 21/032
(52) U.S. Cl. ..... 206/509; 220/7; 220/4.28
(58) Field of Search ..... 220/7, 6, 1.5, 666, 220/4.28; 206/509, 503, 600

(56) References Cited

U.S. PATENT DOCUMENTS

| | | | | |
|---|---|---|---|---|
| 4,167,232 | * | 9/1979 | Munk et al. | 206/509 |
| 4,591,065 | * | 5/1986 | Foy | 220/7 |
| 4,971,201 | * | 11/1990 | Sathre | 206/509 |
| 5,588,549 | * | 12/1996 | Furtner | 220/7 |
| 5,632,392 | * | 5/1997 | Oh | 220/7 |
| 6,073,790 | * | 6/2000 | Umiker | 220/6 |

* cited by examiner

*Primary Examiner*—Stephen Castellano
(74) *Attorney, Agent, or Firm*—Bacon & Thomas, PLLC

(57) ABSTRACT

An improved structure for foldable storage bins, the structure has on the edges of a bottom board upright stop pieces and has tenons and slot mortises on the ends of the side plates, in order to increase stability of the structure; and a plurality of protuberances and engaging recesses are provided at the pivotal connecting areas between the bottom board and the bottom edges of the side plates, so that a side plate can be maintained in its upright position with the protuberances and engaging recesses when it is erected, then another side plate can be erected under the favor of the stability of the former side plate. Some small sheets are provided on the external walls of the side plates at both ends of the storage bin to allow insertion of indicating tags. An inner frame and an outer frame extend downwardly from the external edges of the bottom board, so that when two storage bins are stacked, the inner and outer frames on the upper bin form a groove to engage over the side plates of the lower bin to increase stability of stacking.

2 Claims, 7 Drawing Sheets

STRUCTURE FOR FOLDABLE STORAGE BINS

BACKGROUND OF THE INVENTION

1. Field of the Invention

The present invention is related to an improved structure for foldable storage bins, and especially to an improved structure for storage bins which is structurally firmer after assembling. The structure includes tenons and slot mortises respectively provided for connecting of the side plates in order to prevent the side plates from falling down inwardly; and includes upright stop pieces on the four edges of a bottom board to prevent the side plates from falling down outwardly when the latter are placed upright thereon, thereby, stability of assembling of the side plates can be obtained; and includes an inner frame and an outer frame extending downwardly on the bottom board, so that when two storage bins are stacked with each other, the inner and outer frames on the upper storage bin form a groove to engage over the side plates of the lower storage bin to increase stability of stacking.

2. Description of the Prior Art

A conventional foldable storage bin comprises mainly a square bottom board with four side plates foldable inwardly and pivotably mounted on the four edges thereof; wherein, a pair of mutually opposite side plates each has on both ends thereof an abutting portion protruding inwardly and provided with a plurality of slot mortises, while the other pair of mutually opposite side plates each has on both ends thereof a plurality of corresponding tenons. Thereby, when all the side plates are assembled in their upright positions, the side plates with the abutting portions are abutted against the other pair of mutually opposite side plates, and engagement between all the slot mortises with their corresponding tenons forms a firm connecting structure. The side plates can all be folded down inwardly till the bottom board thereof. So that when the storage bin is not in use, the whole storage bin can be folded into a pile of stacked plates in favor of carrying and storage. However, connecting among the side plates is effected completely by abutment of the abutting portions and engagement between the slot mortises with their corresponding tenons, the storage bin not only is subjected to collapse by collision of an external force, but also is lack of supporting when each side plate is erected singly. While the four side plates cannot be erected at the same time, it is difficult to connect the four side plates mutually; it is unable to maintain good structure strength when the four side plates are stacked. Therefore, practicality of such a storage bin is far inferior to a fixed type storage bin. And this is the very point on that people in the art are eager for an improvement.

SUMMARY OF THE INVENTION

Therefore, the improved structure for foldable storage bins of the present invention is provided on the four edges of a bottom board with upright stop pieces to prevent the side plates from falling down outwardly when the latter are placed upright on the four edges, and is provided with tenons and slot mortises on the ends of the side plates in order to prevent the side plates from falling down inwardly, thereby, stability of assembling of the side plates can be obtained; and is provided with a plurality of protuberances and engaging recesses at the pivotal connecting areas between the bottom board and the bottom edges of the side plates, so that a side plate can be maintained in its upright position with the protuberances and engaging recesses when it is erected, then another side plate can be erected under the favor of the stability of the former side plate. This can increase convenience of using and is the main object of the present invention.

Another object of the present invention is to provide a plurality of small sheets on the external walls of the side plates at both ends of the storage bin, gaps are left between the small sheets and the external walls to allow insertion of indicating tags to show the contents in the storage bin.

Another object of the present invention is to provide an inner frame and an outer frame extending downwardly on the external edges of the bottom board, so that when two storage bins are stacked with each other, the inner and outer frames on the upper storage bin form a groove to engage over the side plates of the lower storage bin to increase stability of stacking.

A further object of the present invention is to provide a plurality of engaging pieces spaced suitably on all the four edges of the bottom board to suit placing over of a plurality of recessed holes provided on the bottom edges of all the four side plates. Such recessed holes mate with the engaging pieces, width of each of the recessed holes is slightly smaller than that of each engaging piece, so that the recessed holes can be quickly slipped over the engaging pieces and prevent the latter from easy releasing. Thus assembling of the four side plates with the bottom board can be completed very fast.

The present invention will be apparent after reading the detailed description of the preferred embodiment thereof in reference to the accompanying drawings.

DETAILED DESCRIPTION OF THE PREFERRED EMBODIMENT

Figure 1:
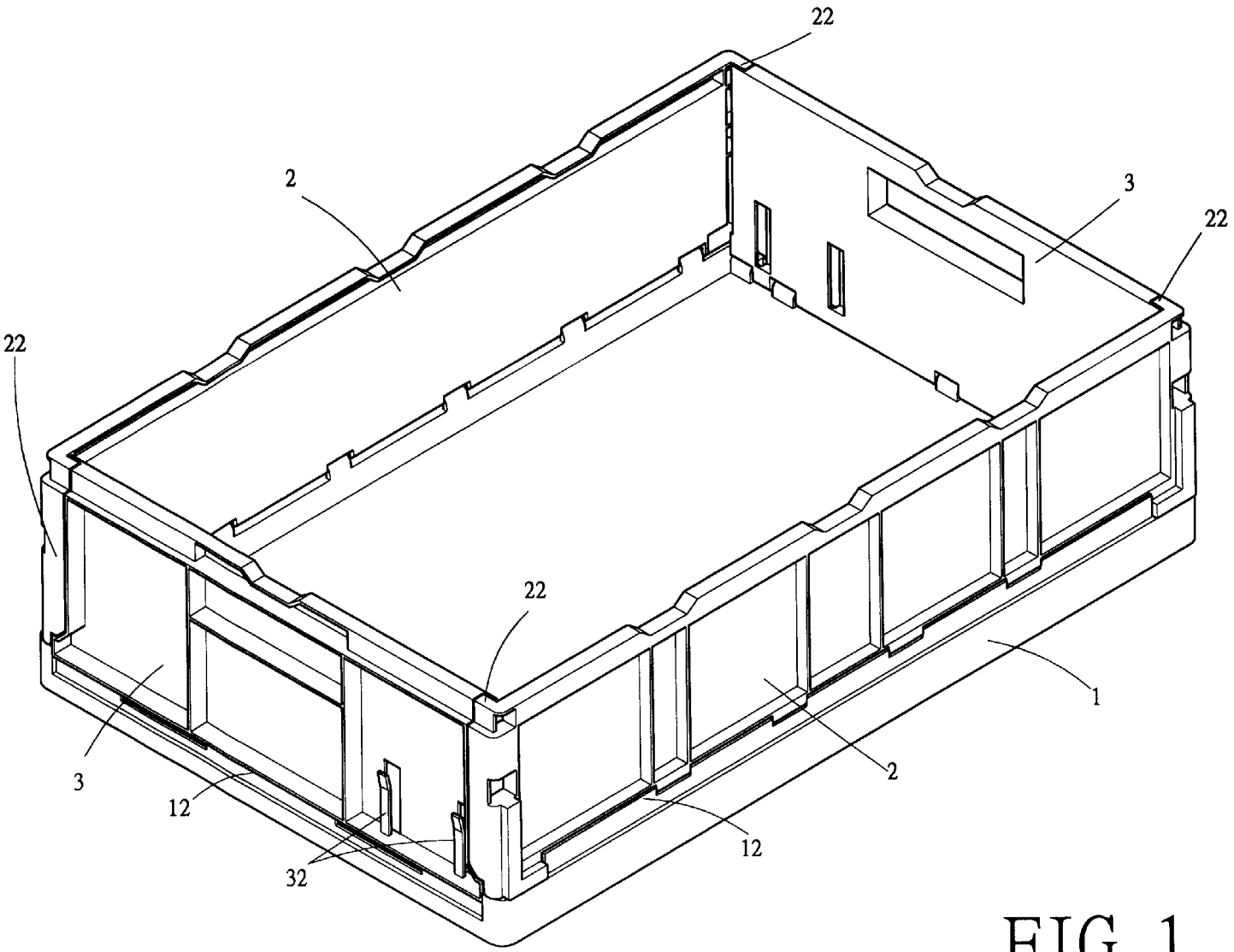
FIG. 1 is a perspective view of a preferred embodiment of a completed storage bin with the present invention.
Figure 2:
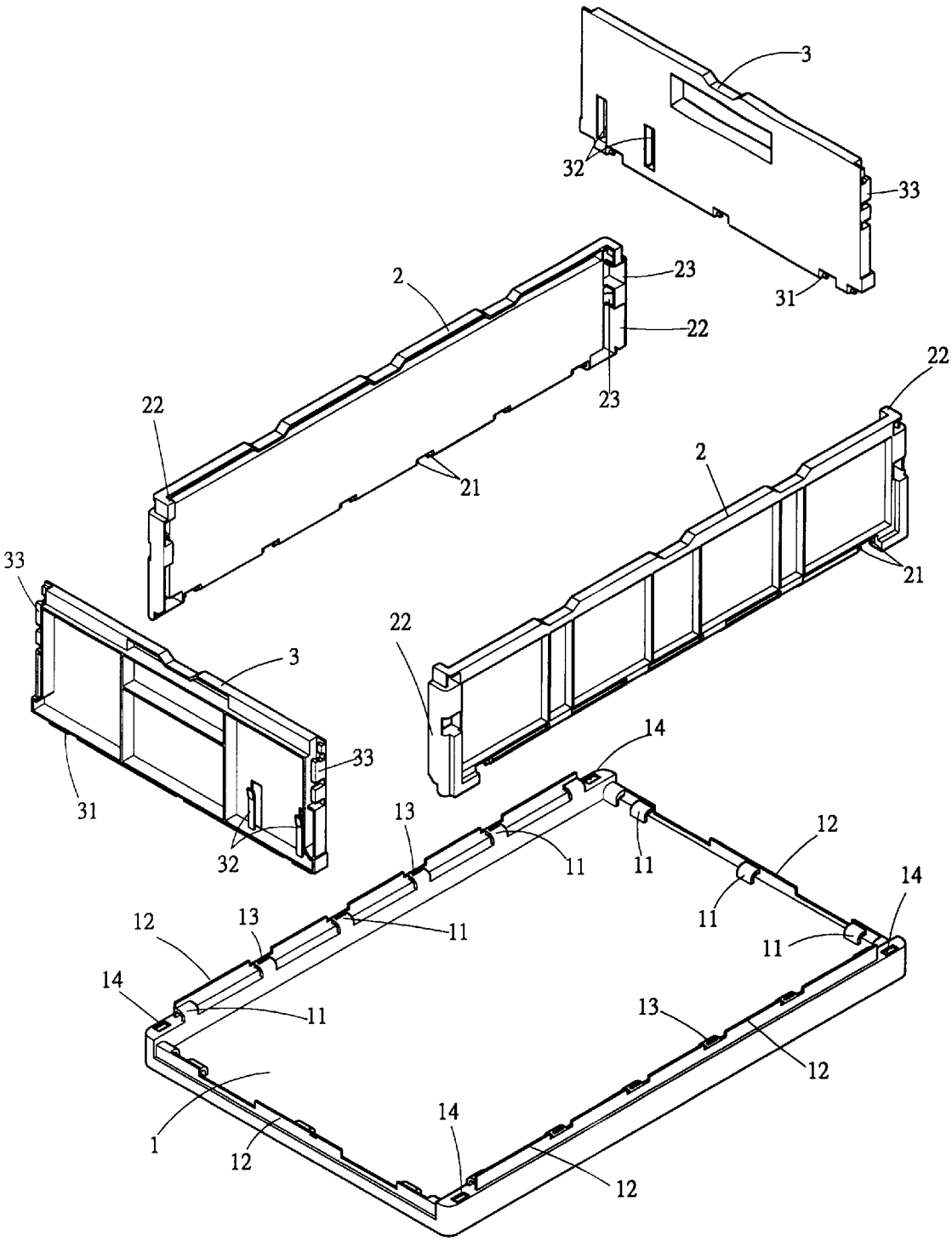
FIG. 2 is an analytic perspective view of the present invention.
Figure 3:
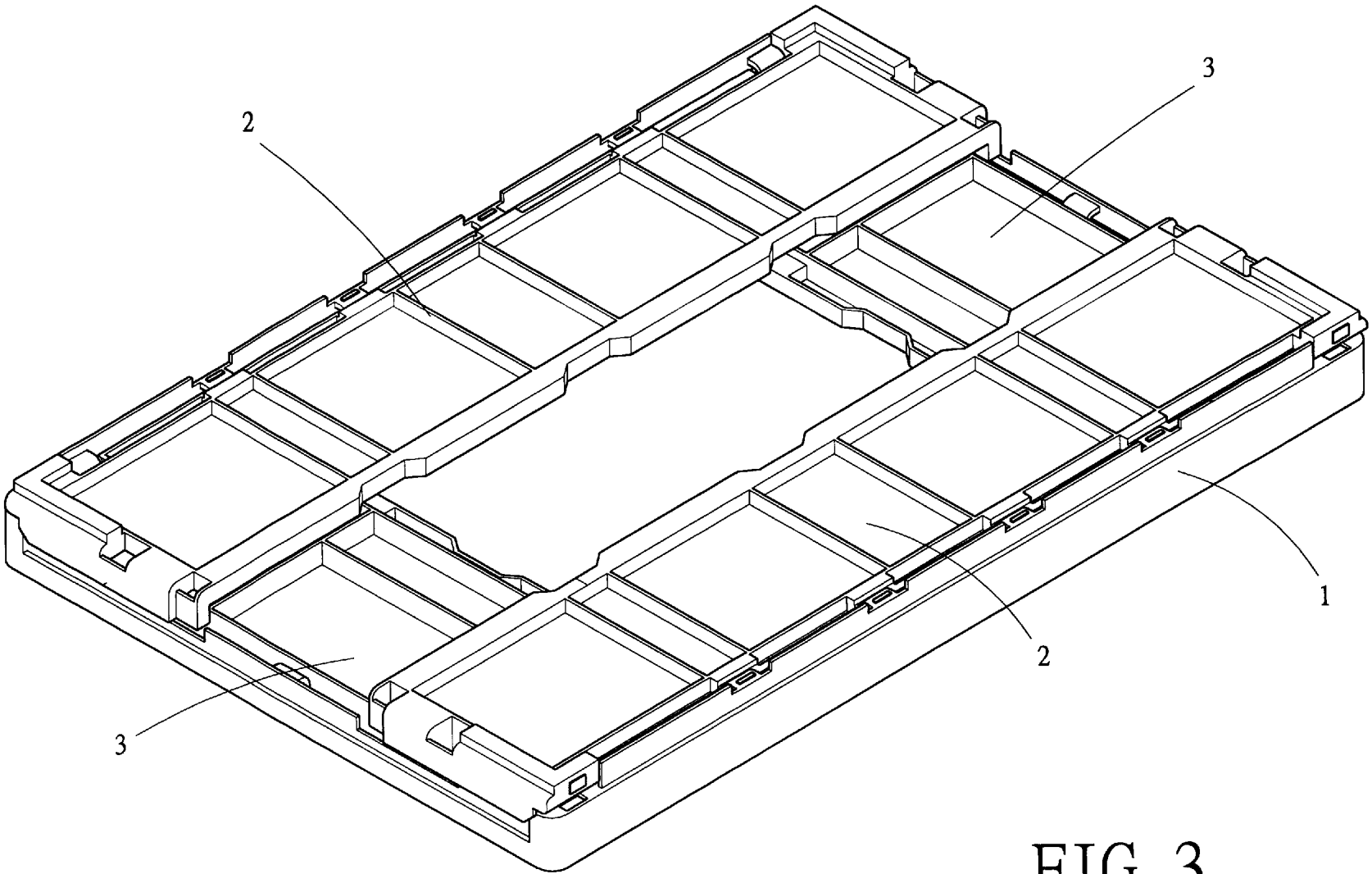
FIG. 3 is a perspective view showing the folded storage bin of the present invention.
Figure 4:
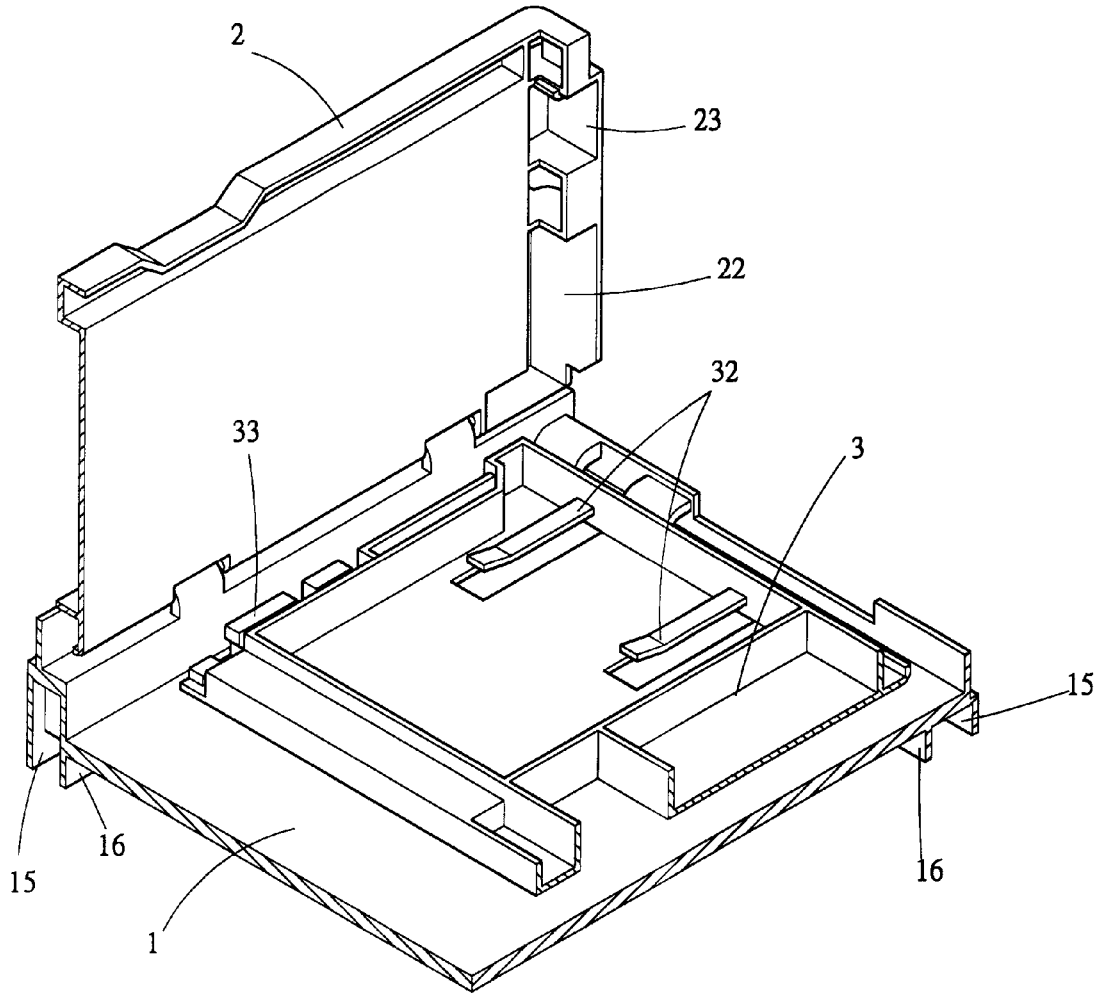
FIG. 4 is an enlarged schematic perspective view partially showing two neighboring side plates of the present invention.

It can be seen from FIG. 1 and 2 that, the improved structure for foldable storage bins of the present invention has a square main body which is a bottom board 1. The bottom board 1 is pivotably connectable on the four edges thereof with two pairs of side plates 2, 3, a plurality of engaging pieces 11 are provided and spaced suitably on all the four edges of the bottom board 1 to suit placing over of a plurality of recessed holes 21, 31 provided on the bottom edges of all the four side plates 2, 3. Referring also to FIG. 4, the mutually opposite side plates 2 in a pair each has on both ends thereof an abutting portion 22 protruding inwardly and provided with a plurality of slot mortises 23, while the mutually opposite side plates 3 in the other pair each has on both ends thereof a plurality of corresponding tenons 33. Thereby, when all the side plates 2, 3 are assembled in their upright positions, the side plates 2 with the abutting portions 22 are abutted against the other pair of mutually opposite side plates 3, and engagement between all the slot mortises 23 and their corresponding tenons 33 forms a firm connecting structure. The structure includes the tenons 33 and slot mortises 23 respectively provided for connecting of the side plates 2, 3 in order to prevent the side plates 3 from falling down inwardly to increase stability of the side plates 3 in assembling. As shown in FIG. 1, the structure includes upright stop pieces 12 on the four edges of the bottom board 1 to prevent the side plates 2, 3 from falling down outwardly when the latter are placed upright thereon. And as shown in FIG. 3, when the storage bin is not used, the side plates 2, 3 can all be folded down inwardly to stack on the bottom board 1, so that the whole storage bin is in the form of a pile of stacked plates in favor of carrying and storage.

Figure 5:
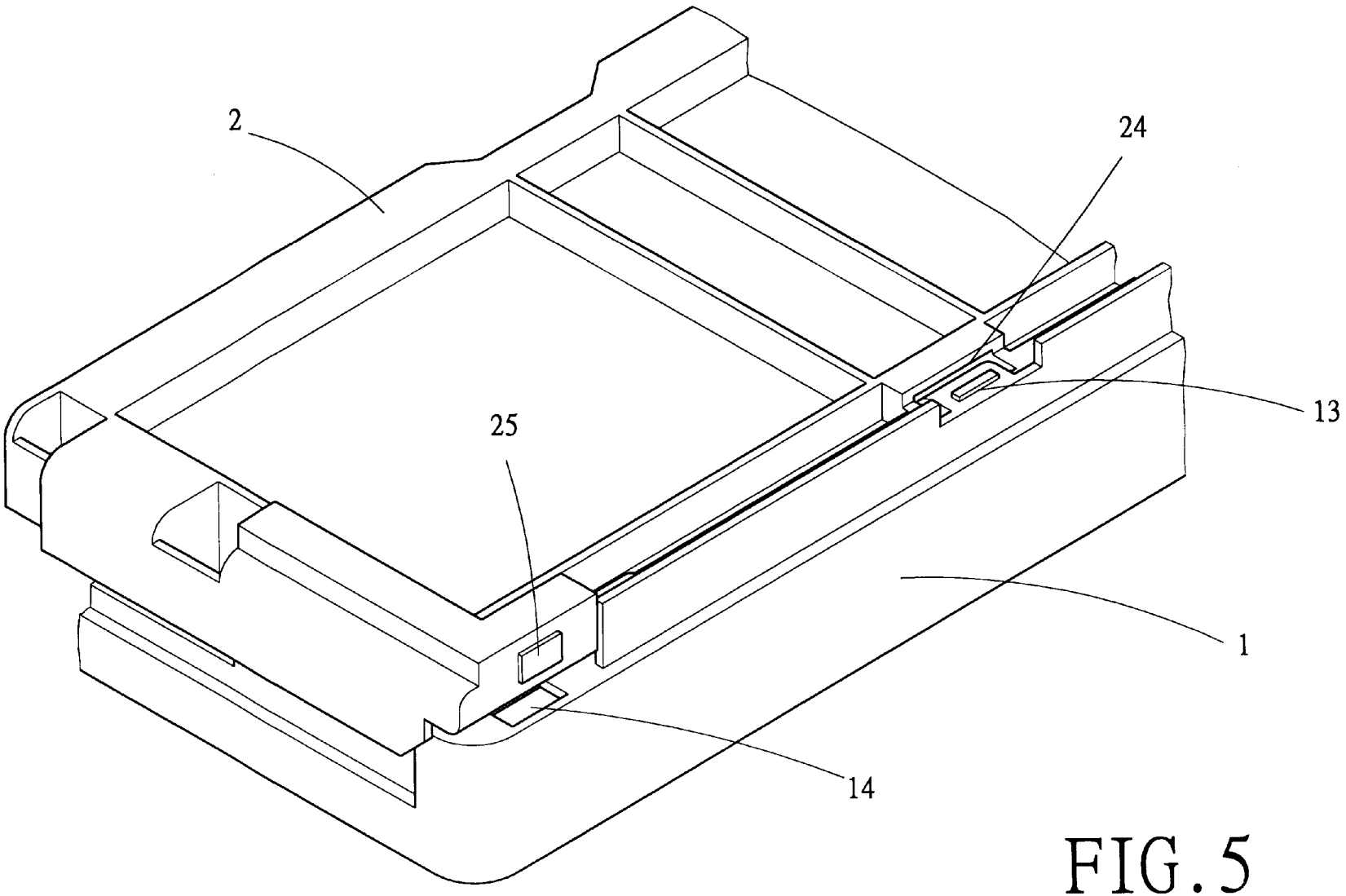
FIG. 5 is an enlarged schematic perspective view partially showing a side plate is folded down on a bottom board of the present invention.
Figure 6:
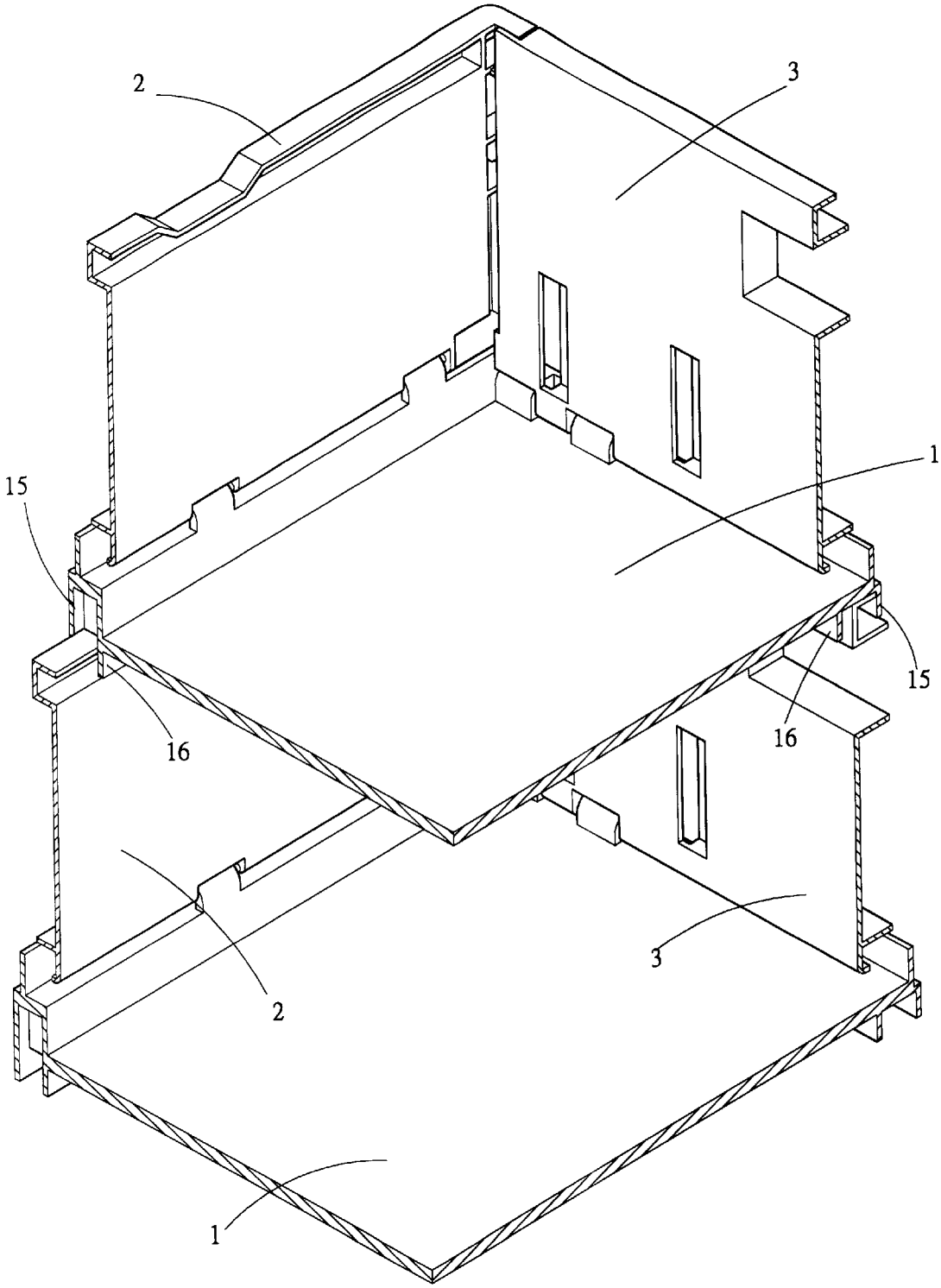
FIG. 6 is an exploded and enlarged schematic perspective view partially showing stacking of two storage bins with the present invention.
Figure 7:
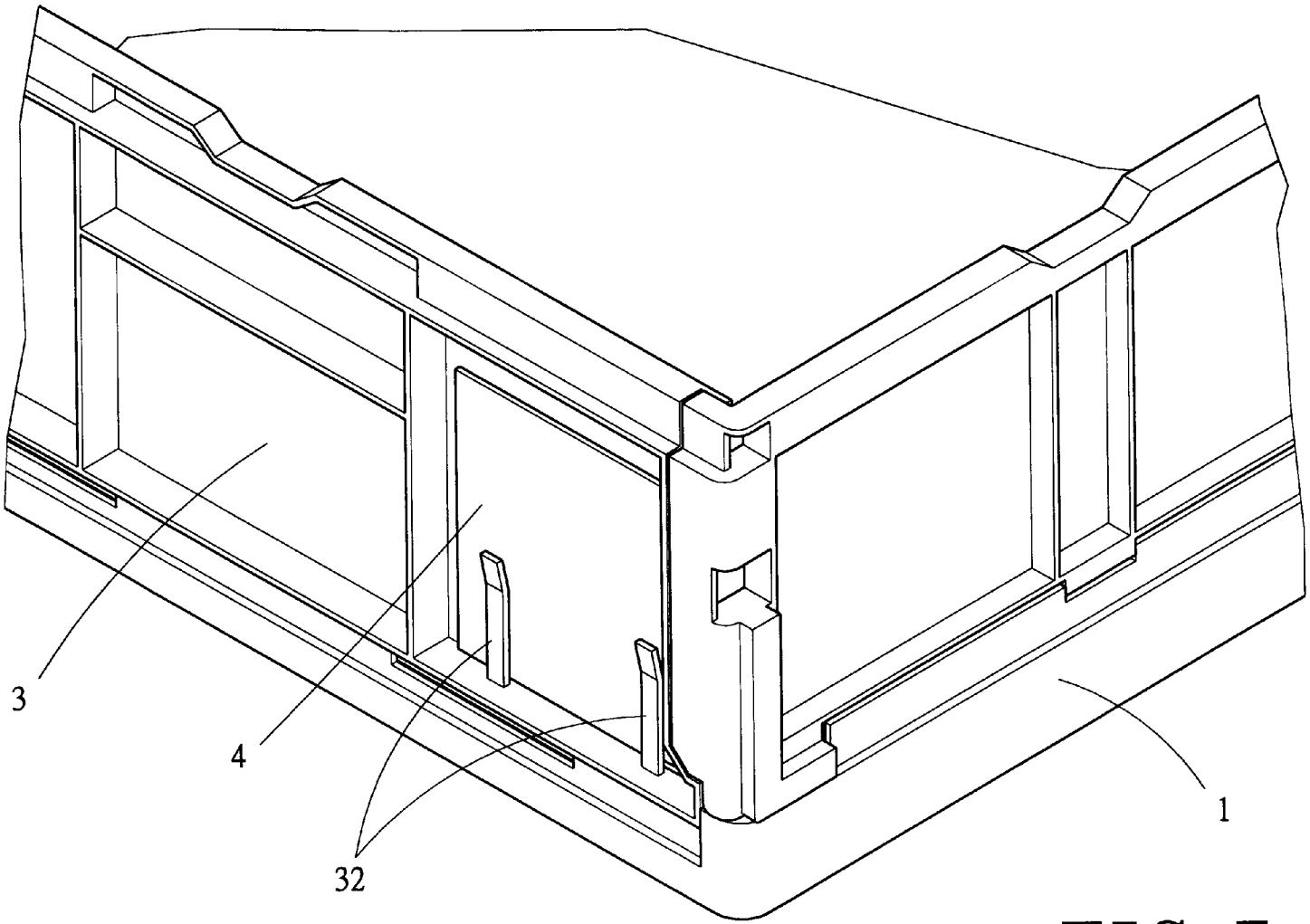
FIG. 7 is a schematic perspective view partially showing an indicating tag on the external wall of a side plate of the storage bin of the present invention.

And as shown in FIG. 5, in the improved structure of the storage bin of the present invention, a plurality of protuberances 13 and engaging recesses 14 are provided on the bottom board 1 at pivotal connecting areas between the bottom board 1 and the bottom edges of the side plates 2, and a plurality of similar protuberances 25 and engaging recesses 24 are provided on the bottom edges of the side plates 2. So that the side plates 2 can be maintained in their upright positions with the protuberances 25 and engaging recesses 24 and the protuberances 13 and engaging recesses 14 in the first place when they are erected, then the other pair of opposite side plates 3 can be erected under the favor of the stability of the former side plates 2. Further as shown in FIG. 7, at least a pair of small upright sheets 32 are provided on the external walls of the side plates 3, gaps are left between the small sheets 32 and the external walls of the side plates 3 to allow insertion of indicating tags 4 to show the contents in the storage bin. And as shown in FIG. 6, an outer frame 15 is formed on the external edges of the bottom board 1 extending downwardly, and an inner frame 16 is formed on the bottom board 1 extending downwardly too. So that when two storage bins are stacked with each other, the inner and outer frames 16, 15 on the upper storage bin form a groove to engage over the side plates 2, 3 of the lower storage bin to increase stability of stacking.

As shown in FIG. 2, by virtue that the bottom board 1 is pivotably connected with the side plates 2, 3 of the storage bin in the present invention by means of the engaging pieces 11 spaced suitably on all the four edges of the bottom board 1 to suit placing over of the recessed holes 21, 31 provided on the bottom edges of all the four side plates 2, 3; and by virtue that recessed holes 21, 31 mate with the engaging pieces 11, width of each of the recessed holes 21, 31 is slightly smaller than that of each engaging piece 11, so that the recessed holes 21, 31 can be quickly slipped over the engaging pieces 11 and prevent the latter from easy releasing. Thus assembling of the four side plates 2, 3 with the bottom board 1 can be completed very fast.

By virtue that the improved structure for foldable storage bins of the present invention is provided on the four edges of the bottom board with the upright stop pieces to prevent the side plates from falling down outwardly when the latter are placed upright on the four edges, and is provided with tenons and slot mortises on the ends of the side plates in order to prevent the side plates from falling down inwardly; and is provided with a plurality of protuberances and engaging recesses at the pivotal connecting areas between the bottom board and the bottom edges of the side plates, so that a pair of side plates can be maintained in their upright positions with the protuberances and engaging recesses in the first place when they are erected, then the other pair of opposite side plates can be erected under the favor of the stability of the former side plates to thereby increase convenience of using. And when two storage bins are stacked with each other, the inner and outer frames on the upper storage bin form a groove to engage over the side plates of the lower storage bin to increase stability of stacking.

Having thus described my invention, what I claim as new and desire to be secured by letters patent of the United States are:

What is claimed is:

1. An improved structure for foldable storage bins, wherein, each of said storage bins has a square bottom board connectable on the four edges thereof with two pairs of side plates foldable inwardly, wherein, a pair of mutually opposite side plates in said two pairs of side plates each has on both ends thereof an abutting portion protruding inwardly and provided with a plurality of slot mortises, while the other pair of mutually opposite side plates in said two pairs of side plates each has on both ends thereof a plurality of corresponding tenons; when all said side plates are assembled in their upright positions, said side plates with said abutting portions are abutted against said other pair of mutually opposite side plates, and engagement between all said slot mortises with said corresponding tenons forms a firm connecting structure; said side plates are adapted to folding down inwardly till said bottom board thereof, when said storage bin is not in use, it is folded into a pile of stacked plates in favor of carrying and storage; said structure for foldable storage bins is characterized by that, said structure includes upright stop pieces on said four edges of said bottom board to prevent said side plates from falling down outwardly when said side plates are placed upright thereon; said firm connecting structure including said slot mortises and said corresponding tenons are provided for connecting every two of said side plates in order to prevent said side plates from falling down inwardly to increase stability of said side plates in assembling; a plurality of protuberances and engaging recesses are provided at the pivotal connecting areas between said bottom board and the bottom edges of said side plates, so that a pair of mutually opposite side plates in said two pairs of side plates are maintained in its upright position with said protuberances and engaging recesses when they are erected, then the other pair of mutually opposite side plates in said two pairs of side plates are erected under the favor of the stability of the former pair of said side plates; a plurality of small sheets are provided on the external walls of all said side plates at both ends of said storage bin, gaps are left between said small sheets and said external walls to allow insertion of indicating tags to show the contents in said storage bin; an inner frame and an outer frame extend downwardly on the external edges of said bottom board, so that when two storage bins same as said storage bin are stacked with each other, said inner and outer frames on the upper of said storage bins form a groove to engage over said side plates of the lower of said storage bins to increase stability of stacking.

2. An improved structure for foldable storage bins as in claim 1, wherein: said bottom board is pivotably connected with said side plates of said storage bin by means of the engaging pieces spaced on all the four edges of said bottom board to suit placing over of a plurality of recessed holes provided on the bottom edges of all said four side plates; and said recessed holes mate with said engaging pieces, width of each of said recessed holes is slightly smaller than that of each of said engaging pieces, so that said recessed holes are quickly slipped over said engaging pieces and prevent the latter from easy releasing, thus assembling of said four side plates with said bottom board is completed very fast.

* * * * *